US009646552B2

(12) United States Patent
Takada et al.

(10) Patent No.: US 9,646,552 B2
(45) Date of Patent: May 9, 2017

(54) DISPLAY DEVICE WITH A SOURCE SIGNAL GENERATING CIRCUIT

(75) Inventors: Naoki Takada, Yokohama (JP); Yasuyuki Kudo, Fujisawa (JP); Norio Mamba, Kawasaki (JP); Takuya Eriguchi, Yokosuka (JP); Tsutomu Furuhashi, Yokohama (JP); Shinichi Iwasaki, Mobara (JP)

(73) Assignees: Japan Display Inc., Tokyo (JP); Panasonic Liquid Crystal Display Co., Ltd., Hyogo (JP)

( * ) Notice: Subject to any disclaimer, the term of this patent is extended or adjusted under 35 U.S.C. 154(b) by 528 days.

(21) Appl. No.: 12/314,380

(22) Filed: Dec. 9, 2008

(65) Prior Publication Data

US 2009/0146938 A1 Jun. 11, 2009

(30) Foreign Application Priority Data

Dec. 10, 2007 (JP) ..... 2007-317854

(51) Int. Cl.
*G09G 3/36* (2006.01)

(52) U.S. Cl.
CPC ..... *G09G 3/3648* (2013.01); *G09G 3/3614* (2013.01); *G09G 2310/08* (2013.01); *G09G 2320/0233* (2013.01); *G09G 2320/0257* (2013.01)

(58) Field of Classification Search
USPC ..... 345/98, 99, 100
See application file for complete search history.

(56) References Cited

U.S. PATENT DOCUMENTS

| | | | | |
|---|---|---|---|---|
| 7,593,007 | B2 * | 9/2009 | Wu et al. | G09G 3/3413 345/100 |
| 7,868,860 | B2 * | 1/2011 | Watanabe et al. | 345/87 |
| 2003/0112403 | A1 * | 6/2003 | Ino | 349/152 |
| 2005/0001800 | A1 * | 1/2005 | Ha | 345/87 |
| 2005/0219276 | A1 * | 10/2005 | Nose et al. | 345/690 |
| 2006/0082603 | A1 * | 4/2006 | Shimada | G02F 1/133528 345/690 |
| 2007/0008270 | A1 * | 1/2007 | Mamba et al. | 345/98 |
| 2007/0091050 | A1 * | 4/2007 | Katayama et al. | 345/98 |
| 2007/0188523 | A1 * | 8/2007 | Lee et al. | G09G 3/3614 345/690 |
| 2007/0268233 | A1 * | 11/2007 | Hashimoto et al. | 345/100 |
| 2008/0079703 | A1 * | 4/2008 | Yamagami | 345/205 |
| 2009/0085858 | A1 * | 4/2009 | Hsu et al. | 345/100 |

(Continued)

FOREIGN PATENT DOCUMENTS

| | | |
|---|---|---|
| JP | 2000-275611 | 3/1999 |
| JP | 2004-045967 | 7/2002 |
| JP | 2006-267525 | 3/2005 |

*Primary Examiner* — Kwang-Su Yang
(74) *Attorney, Agent, or Firm* — Juan Carlos A. Marquez; Marquez IP Law Office, PLLC

(57) ABSTRACT

In RGB time division drives, there is capacitor coupling due to the effects of fluctuation in the drain lines, and thus, the image quality deteriorates (lateral smearing), so that the display brightness becomes different from the desired display brightness due to delay in the convergence of the fluctuation of the common potential, and thus, it is a goal to prevent the image quality from deteriorating (lateral smearing). In RGB time division drives, the order of time division is switched for each frame, or in the direction of the horizontal lines.

1 Claim, 12 Drawing Sheets

(56) References Cited

U.S. PATENT DOCUMENTS

| | | | | |
|---|---|---|---|---|
| 2011/0221796 | A1* | 9/2011 | Wada et al. | 345/690 |
| 2013/0100111 | A1* | 4/2013 | Shirai | G09G 3/2011 345/212 |

* cited by examiner

DISPLAY DEVICE WITH A SOURCE SIGNAL GENERATING CIRCUIT

BACKGROUND OF THE INVENTION

The present invention relates to a liquid crystal display device, and in particular, to a drive system and a drive circuit for a liquid crystal display in accordance with a time division system in which a source signal generating circuit is mounted.

The mobility of poly-Si (polysilicon) under electrical field effects is greater than the mobility of amorphous Si under electrical field effects, which is approximately 0.5 to 1 $cm^2/Vs$, by approximately several tens to 200 $cm^2/Vs$. Therefore, peripheral circuits, such as signal circuits and scanning circuits, can be formed on the same substrate as the liquid crystal display portion using poly-Si TFT's. In addition, periphery circuits and a liquid crystal display portion can be formed on the same substrate using poly-Si TFT's, and thus, connection with external peripheral circuits, such as source signal generating circuits, becomes unnecessary, and it becomes possible to implement a liquid crystal display device with high resolution. In the case where a liquid crystal display device with high precision and high resolution is implemented, however, the clock frequency in periphery circuits, particularly signal circuits, increases to several tens of MHz. However, the operation frequency in peripheral circuits using poly-Si TFT's is as low as approximately several MHz to approximately 10 MHz, and thus, it is difficult to implement liquid crystal display devices with high resolution where peripheral circuits are formed around the liquid crystal display portion.

Therefore, an RGB time division driving system where time division switches provided on the same substrate as the liquid crystal display portion and a driver IC are used, for example, has been proposed as a means for implementing a liquid crystal display device with high precision and high resolution using poly-Si TFT's. As described in Japanese Unexamined Patent Publication 2000-275611 (Patent Document 1), this system uses a source signal generating circuit as a signal circuit which requires high-speed operation. The source signal generating circuit is operable with a high frequency of several tens of MHz, and a number of display signals can be outputted collectively. In liquid crystal display devices using an RGB time division driving system, one output terminal for the source signal generating signal and three drain lines (drain lines corresponding to each pixel: R, G and B) included in the liquid crystal display portion are connected via time division switches provided on the same substrate as the liquid crystal display portion. In the RGB time division driving system, one horizontal period is time divided into three periods, and one drain line is selected from among three drain lines corresponding to R, G and B during each period in sequence. The source signal generating circuit outputs display data corresponding to the drain line selected by the time division switch from the output terminal. As a result, a display signal corresponding to the display data is applied to the liquid crystal inside the liquid crystal panel, and thus, gradation display is implemented. Thus, it becomes possible to make the number of output terminals of the source signal generating circuit ⅓ of the number of drain lines (=number of horizontal pixels) in the liquid crystal portion in accordance with the RGB time division driving system, and it also becomes possible to reduce the number of source signal generating circuits in comparison with conventional line sequence driving systems. In addition, it also becomes possible to reduce the number of connection terminals between the substrate where the liquid crystal display portion and the time division switch are formed and the source signal generating circuits to ⅓ of conventional line sequence driving systems, and thus, it becomes possible to implement a liquid crystal display device with higher precision and higher resolution.

SUMMARY OF THE INVENTION

In RGB time division drives, one output terminal of a source signal generating circuit and three drain lines (drain lines corresponding to each pixel: R, G and B) included in a liquid crystal display portion are connected, so that the writing in of R data, the writing in of G data and the writing in of B data are carried out through time division. The above described write-in indicates application of a voltage corresponding to display data on the pixel electrode side from the drain line for each pixel. In this case, the side of the counter electrode facing the pixel electrode with a liquid crystal capacitor in between, is connected to a common line and becomes of a common potential. The common potential is the same for all of the pixels in the frame inversion drive, and the prior art provides a configuration where the common potential is the same for all of the pixels. There is capacitor coupling on the counter electrode side when the potential of the drain line fluctuates according to the timing with which R, G and B data is written in, and the common potential fluctuates in accordance with the amount of fluctuation in the drain line. Here, in conventional line sequence driving systems, only the time for starting one horizontal period fluctuates, while in RGB time division drive, the potential of the drain line fluctuates in accordance with the timing with which R, G and B data is written in, as described above, and therefore, the convergence of the common potential is delayed, and the image quality deteriorates, due to the display brightness being different from the desired display brightness. Accordingly, in conventional RGB time division drives, it is a goal to suppress deterioration in image quality due to the actual display brightness being different from the desired display brightness.

An object of the present invention is to provide a display device in an RGB time division drive system, where the image quality can be prevented from deteriorating due to change in the actual display brightness, as well as a driving method for the same.

The liquid crystal display device according to an embodiment of the present invention has: a liquid crystal display portion where a number of drain lines and a number of gate lines which cross each other are formed and pixels are formed of a liquid crystal cell and a switching element, so as to correspond to the intersections; a number of time division switches which can select any drain line from among the above described number of drain lines corresponding to a predetermined number of time divisions; a number of control signal lines for controlling whether the above described time division switches are in a selected or non-selected state; a number of display signal lines for transmitting a display signal to the above described time division switches; and a source signal generating circuit for outputting the above described display signal to the above described display signal lines from an output terminal in accordance with time series corresponding to the predetermined number of time divisions, and is characterized in that during an arbitrary vertical period, time division switches are selected during the first to Nth (N is a natural number of 2 or higher) selection periods, from among a number of selection periods gained through division by the number of the above described predetermined time divisions, and the time division switches are selected in order from the first to Nth time division switch, an appropriate display signal is supplied to a drain line via the division switches, the order of selection for the time division switches is reversed during the above described first selection period to the Nth selection period from a certain vertical period to the Xth (X is a natural number of 1 or higher) vertical period, a display signal is supplied to a drain line via the time division switches, so that the drain lines hold display signals in sequence, and thus, liquid crystal cells along the gate lines in a selected state are activated, and the above described source signal generating circuit outputs display signals corresponding to pixels which become of a held state during the respective selection periods in time series corresponding to the above described predetermined number of time divisions.

In addition, the above described liquid crystal display device is characterized in that during one arbitrary vertical period, time division switches are selected during the first to Nth (N is a natural number of 2 or higher) selection periods, from among a number of selection periods gained through division by the number of the above described predetermined time divisions, and the time division switches are selected in order from the first to Nth time division switch, an appropriate display signal is supplied to a drain line via the division switches, the first time division switch and one or more time division switches to be selected outside the first selection period are selected during the first selection period, at the time of the completion of the first selection period time division switches other than the second time division switch to be selected during the second selection period from among the first time division switch and the time division switches to be selected outside the first selection period that have been selected become of a non-selected state, and a display signal is supplied to a drain line via the time division switches, so that the drain lines hold display signals in sequence, and thus, liquid crystal cells along the gate lines in a selected state are activated, and the above described source signal generating circuit outputs display signals corresponding to pixels which become of a held state during the respective selection periods in time series corresponding to the above described predetermined number of time divisions. In addition, the above described liquid crystal display device is characterized in that in the case where each pixel is formed of sub-pixels: R, G and B, a configuration where a first drain line and a first time division switch correspond to a sub-pixel R, a second drain line and a second time division switch correspond to a sub-pixel G, and a third drain line and a third time division switch correspond to a sub-pixel D is one control unit, and there are three control signal lines for a time division switch which controls a control unit: a first control signal line from among the three control signal lines controls the first time division switch within a first control unit, a second control signal line controls the second time division switch, and a third control signal line controls the third time division switch, a first control signal line controls the second time division switch, a second control signal line controls the third time division switch, and a third signal line controls the first time division switch in a second control unit adjacent to the first control unit, a first control signal line controls the third time division switch, a second control signal line controls the first time division switch, and the third control signal line controls the second time division switch in a third control unit which is adjacent to the first and second control units, and display signals are supplied to the drain lines via the time division switches, so that the drain lines hold a display signal in sequence, and thus, liquid crystal cells along the above described gate lines in a selected state are activated, and the above described source signal generating circuit outputs display signals corresponding to pixels which become of a held state during the respective selection periods in time series corresponding to the above described predetermined number of time divisions.

In addition, the liquid crystal display device according to an embodiment of the invention has: a liquid crystal display portion where a number of drain lines and a number of gate lines which cross each other are formed and pixels are formed of a liquid crystal cell and a switching element, so as to correspond to the intersections; a number of time division switches which can select any drain line from among the above described number of drain lines corresponding to a predetermined number of time divisions; a number of control signal lines for controlling whether the above described time division switches are in a selected or non-selected state; a number of display signal lines for transmitting a display signal to the above described time division switches; and a source signal generating circuit for outputting the above described display signal to the above described display signal lines from an output terminal in accordance with time series corresponding to the predetermined number of time divisions, and in the case where each pixel is formed of sub-pixels: R, G and B, a configuration where a first drain line and a first time division switch correspond to a sub-pixel R, a second drain line and a second time division switch correspond to a sub-pixel G, a third drain line and a third time division switch correspond to a sub-pixel B, and a fourth time division switch for controlling a third drain line corresponding to a sub-pixel B is one control unit in the liquid crystal display device, there are three control signal lines for a time division switch which controls a control unit: a first control signal line from among the three control signal lines controls the first time division switch and the fourth time division switch within a first control unit, a second control signal line controls the second time division switch, and a third control signal line controls the third time division switch, and display signals are supplied to the drain lines via the time division switches, so that the drain lines hold a display signal in sequence, and thus, liquid crystal cells along the above described gate lines in a selected state are activated, and the above described source signal generating circuit outputs display signals corresponding to pixels which become of a held state during the respective selection periods in time series corresponding to the above described predetermined number of time divisions.

In addition, the present invention is characterized in that the type of display signal: R, G or B, supplied to a previous pixel within one horizontal period is switched frame by frame (that is to say, in the direction of time) or pixel by pixel (that is to say, within the same space).

According to the present invention, a first frame, where the order in which data is written in through time division is the order of RGB data, and a second frame, where the order is the order of BGR data, are switched in the RGB time division drive of the liquid crystal panel having a time division switch.

In addition, the present invention provides a configuration where the control signal line for the time division switch and the time division switch RGB data are connected, so that ⅓ of the group of display signal lines writes in R data (or G or B data) during the first selection period, ⅓ of the group of display signal lines writes in R data (or G or B data) during the second selection period, and ⅓ of the group of display signal lines writes in R data (or G or B data) during the third selection period.

When a drive operation and a timing operation are carried out in the above described configuration, fluctuation can be prevented in the common potential, or the fluctuation can be dispersed, and thus, it can be expected that the image quality can be prevented from deteriorating due to inconsistency in the display brightness, that is to say, lateral smearing.

In addition, it becomes possible to reduce the number of connection terminals between the liquid crystal panel (time division switch) and the source signal generating circuit through RGB time division drive. As a result, higher precision and higher resolution can be expected in the liquid crystal panel. Furthermore, it becomes possible to increase the yield in manufacture, because the number of connection terminals can be reduced. At the same time, the cost for the liquid crystal display device can be expected to lower when the number of terminals is reduced in the source signal generating circuit.

In addition, according to the present invention, the type of display signal RGB supplied to a previous pixel within each horizontal period is switched frame by frame, and therefore, the fluctuation in the common potential can be dispersed in the direction of time, and thus, it can be expected that the image quality as viewed by the human eye can be prevented from deteriorating due to inconsistency in the display brightness, that is to say, lateral smearing.

In addition, according to the present invention, the type of display signal RGB supplied to a previous pixel within each horizontal period is switched pixel by pixel, and therefore, the fluctuation in the common potential can be set off within the same space, and thus, the fluctuation in the common potential can be reduced, and it can be expected that the image quality can be prevented from deteriorating due to inconsistency in the display brightness, that is to say, lateral smearing.

BRIEF DESCRIPTION OF THE DRAWINGS

These and other features, objects and advantages of the present invention will become more apparent from the following description when taken in conjunction with the accompanying drawings, wherein.

DESCRIPTION OF THE EMBODIMENTS

In the following, the first and second embodiments of the present invention are described.

In the following, the first embodiment of the present invention is described in reference to FIGS. 1 to 10.

Figure 1:
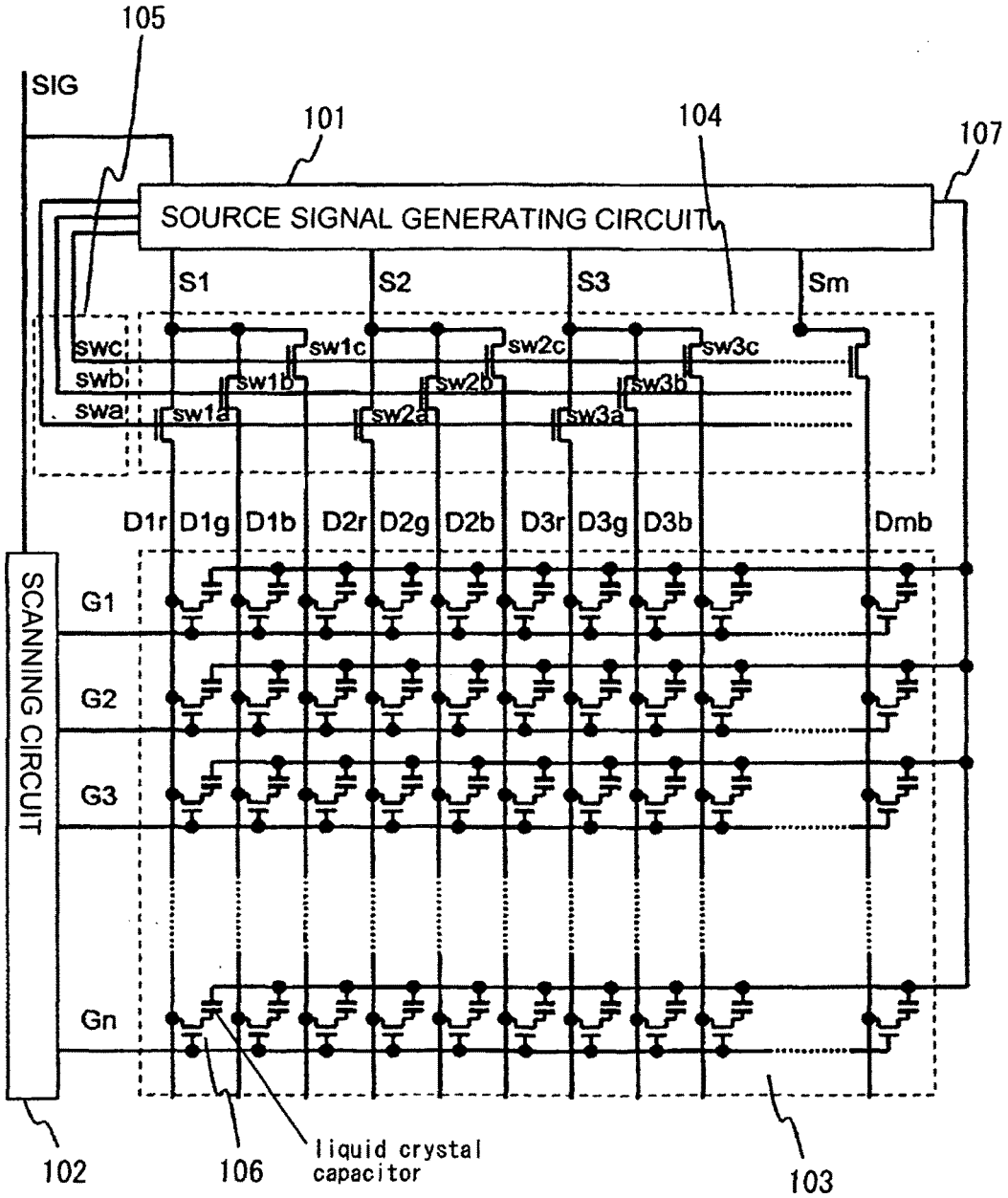
FIG. 1 is a diagram showing the configuration of a liquid crystal display device according to a first embodiment of the present invention.
Figure 2:
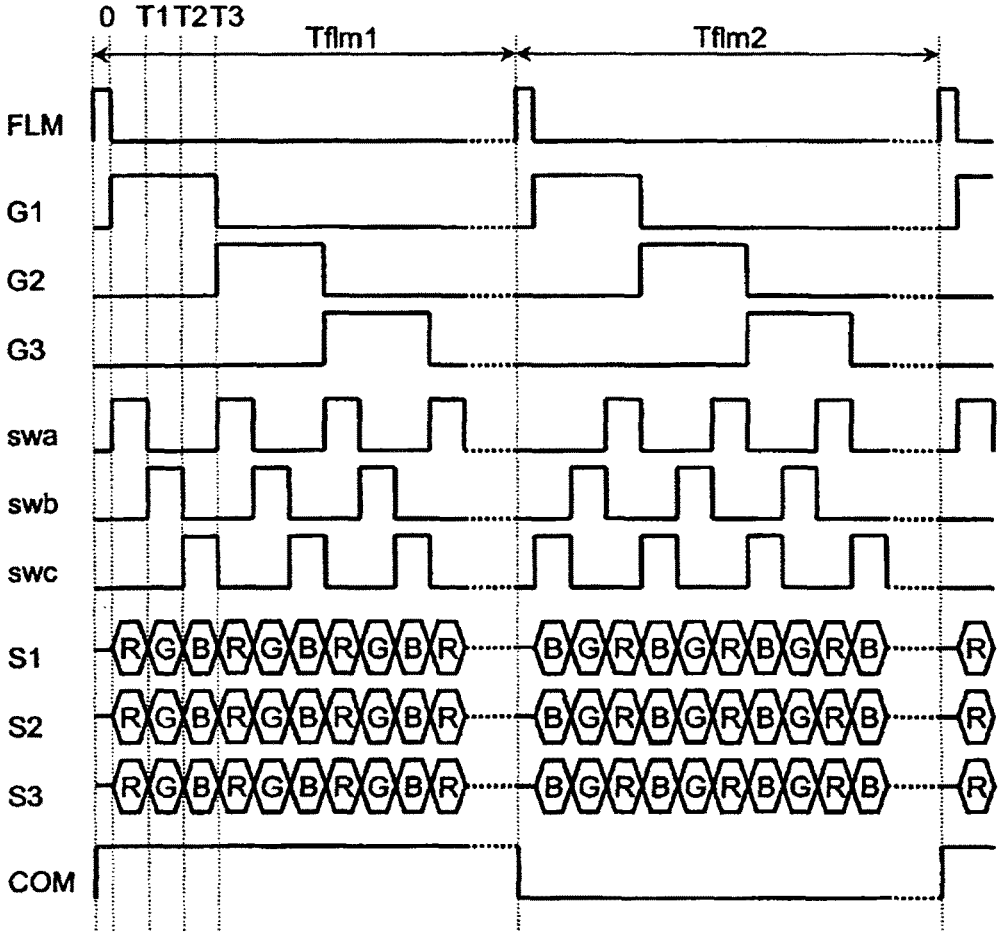
FIG. 2 is a chart showing voltage waveforms and timing according to the first embodiment of the present invention.

First, the configuration of the liquid crystal display device according to the first embodiment of the present invention is described in reference to FIGS. 1 and 2, citing RGB time division drive as one example.

FIG. 1 is a diagram showing the configuration of the liquid crystal display device according to the first embodiment of the present invention. In FIG. 1, 101 is a source signal generating circuit, and the source signal generating circuit outputs a group of display signal lines (S1, S2, S3 . . . ) for transmitting a display signal (a positive [high-potential] signal or a negative [low potential] signal relative to the potential of the counter electrode) to a liquid crystal panel 103. Here, the source signal generating circuit 101 outputs display signals of the same polarity from even and odd terminal to the group of display signal lines. The group of display signal lines is connected to a group of drain lines (Dr1, Dg1, Db1, Dr2, Dg2, Db2, Dr3, Dg3, Db3 . . . ) via a group of time division switches 104 (sw1*a*, sw1*b*, sw1*c*, sw2*a*, sw2*b*, sw2*c*, sw3*a*, sw3*b*, sw3*c* . . . ). In addition, the ON/OFF state of the group of time division switches 104 is controlled by a group of control signals 105, so that a display signal line S and a drain line D are connected in the ON state and a display signal line S and a drain line D are disconnected in the OFF state. Here, in the case of RGB time division drive, one display signal line S is connected to three time division switches sw, and three drain lines D are respectively connected to these three time division switches. In reference to FIG. 1, the display signal line S1 is connected to the drain lines Dr1, Dg1 and Db1 via three time division switches sw1*a*, sw1*b* and sw1*c*. These three drain lines D are connected to pixels R, G and B, respectively. Though in this description, R, G and B are allocated to three drain lines in this order from the left, the order is not particularly limited. Likewise, other display signal lines (S2, S3 . . . ) are respectively connected to drain lines (Dr2, Dg2, Db2, Dr3, Dg3, Db3 . . . ) via time division switches (sw2*a*, sw2*b*, sw2*c*, sw3*a*, sw3*b*, sw3*c* . . . ). Accordingly, the total number of outputs of display signals from the source signal generating circuit 101 (=total number of display signal lines) becomes ⅓ of the number of pixels in the liquid crystal panel 103 in the horizontal direction (RGB×number of horizontal pixels). Here, one source signal generating circuit (number of pixels in horizontal direction: 1440 (=number of horizontal pixels: 480×RGB)/480/3) becomes necessary when the resolution of the liquid crystal panel is VGA and the number of outputs of display signals from the source generating circuit is 480. Here, there may be any number of output terminals in one source signal generating circuit 101 and any number of source signal generating circuits 101 used in the liquid crystal display device, and an appropriate number may be used in accordance with the resolution of the liquid crystal panel 103.

Meanwhile, in FIG. 1, 102 is a gate scanning circuit which sequentially selects gate scanning lines (G1, G2, G3 . . . ) in a group. The number of gate scanning lines G is at least the same or greater than the number of pixels in the liquid crystal panel in the vertical direction. Switching elements 106 formed of an nMOS-TFT, for example, are provided in the vicinity of respective intersections between gate scanning lines (G1, G2, G3 . . . ) and drain lines (Dr1, Dg1, Db1, Dr2, Dg2, Db2, Dr3, Dg3, Db3 . . . ). These switching elements 106 may be made of a pMOS-TFT or the like instead of an nMOS-TFT, but in the present description they are an nMOS-TFT. The gate of the switching elements 106 is connected to a gate scanning line G, the drain is connected to a drain line D, and the source is connected to a pixel electrode of the liquid crystal capacitor. 107 is a common line C which is connected to a counter electrode formed on another substrate provided so as to face the substrate on which the pixel electrodes are formed. This is a case of liquid crystal of which the transmittance is controlled by a longitudinal electrical field, and in the case of liquid crystal of which the transmittance is controlled by a lateral electrical field, the counter electrode is formed on the same substrate as the pixel electrodes. The liquid crystal capacitor is sandwiched between the pixel electrodes and the counter electrode. The transmittance of the liquid crystal is determined by the difference in potential between the counter electrode and the pixel electrodes, and in the liquid crystal display device, the difference in potential is controlled, and thus, gradation display can be carried out.

Next, the operation of the writing in of a display signal during one horizontal period according to the first embodiment of the present invention is described in reference to FIG. 2. FIG. 2 is a chart showing voltage waveforms and timing according to the first embodiment of the present invention, where a case where a display signal in a gate selected state is written in during one certain horizontal period during the vertical period (Tflm1), where operation for the writing in of a negative display signal is carried out, and during the vertical period (Tflm2), where operation for the writing in of a positive display signal is carried out, is cited as an example. The gate scanning voltage G in FIG. 2 exhibits a gate voltage waveform of a horizontal line in a write-in state, and the gate selection period is within one horizontal period. According to the first embodiment of the present invention, one horizontal period is time divided into a first selection period from time 0 to time T1, a second selection period from time T1 to time T2 and a third selection period from time T2 to time T3 when the gate scanning voltage rises at time 0 in the case of RGB time division drive. Here, any time can be set for time T1, T2 and T3, as long as the time satisfies the relationship 0<T1<T2<T3. According to the first embodiment of the present invention, as shown in the waveform for the control signal in FIG. 2, all time division switches corresponding to R during the first selection period, that is, from time 0 to time T1, are in the ON state, all time division switches corresponding to G during the second selection period, that is, from time T1 to time T2, are in the ON state, and all time division switches corresponding to B during the third selection period, that is, from time T2 to time T3, are in the ON state during the vertical period (Tflm1), where operation for the writing in of a negative display signal is carried out. Meanwhile, all time division switches corresponding to B during the first selection period, that is, from time 0 to time T1, are in the ON state, all time division switches corresponding to G during the second selection period, that is, from time T1 to time T2, are in the ON state, and all time division switches corresponding to R during the third selection period, that is, from time T2 to time T3, are in the ON state during the vertical period (Tflm2), where operation for the writing in of a positive display signal is carried out. That is to say, the drive order in RGB time division drive is R→G→B during the Tflm1 period, and the drive order in RGB time division drive is B→G→R during the Tflm2 period, and thus, the drive period is completed in two frames.

Figure 3:
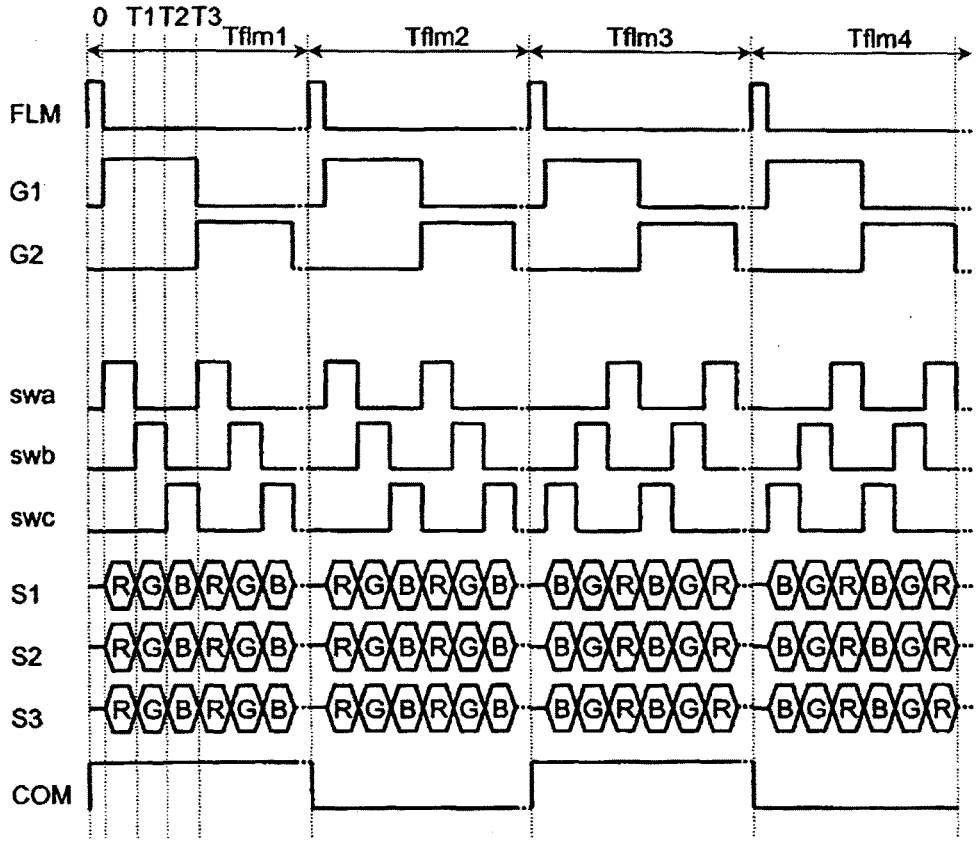
FIG. 3 is a chart showing voltage waveforms and timing according to the first embodiment of the present invention.

Next, FIG. 3 is described. FIG. 3 is a diagram illustrating operation of the writing in of a display signal during one horizontal period according to the first embodiment of the present invention, as is FIG. 2. Though in FIG. 2, the order of write-in in RGB time division drive is switched from RGB to BGR for every vertical period where operation for the writing in of a positive display signal is carried out, and every vertical period where operation for the writing in of a negative display signal is carried out, in FIG. 3 a vertical period where operation for the writing in of a positive display signal is carried out and a vertical period where operation for the writing in of a negative display signal is carried out are dealt with as one set, and the order of write-in in RGB time division drive during one set of vertical periods is RGB and the order of write-in in RGB time division drive during the next set of vertical periods is BGR. In FIG. 3, vertical periods where operation for the writing in of a negative display signal is carried out are Tflm1 and Tflm3, while vertical periods where operation for the writing in of a positive display signal is carried out are Tflm2 and Tflm4. As shown in the waveform for the control signal in FIG. 3, all time division switches within the group of time division switches corresponding to R are in the ON state during the first selection period, that is to say, from time 0 to time T1, all time division switches within the group of time division switches corresponding to G are in the ON state during the second selection period, that is to say, from time T1 to time T2, and all time division switches within the group of time division switches corresponding to B are in the ON state during the third selection period, that is to say, from time T2 to time T3 during the vertical periods Tflm1 and Tflm2. Meanwhile, all time division switches within the group of time division switches corresponding to B are in the ON state during the first selection period, that is to say, from time 0 to time T1, all time division switches within the group of time division switches corresponding to G are in the ON state during the second selection period, that is to say, from time T1 to time T2, and all time division switches within the group of time division switches corresponding to R are in the ON state during the third selection period, that is to say, from time T2 to time T3 during the vertical periods Tflm2 and Tflm4, where the operation for the writing in of a positive display signal is carried out. That is to say, the drive order in RGB time division drive is R→G→B during the Tflm1 and Tflm2 periods, and the drive order in RGB time division drive is B→G→R during the Tflm2 period, and thus, the drive period is completed in four frames.

Figure 4:
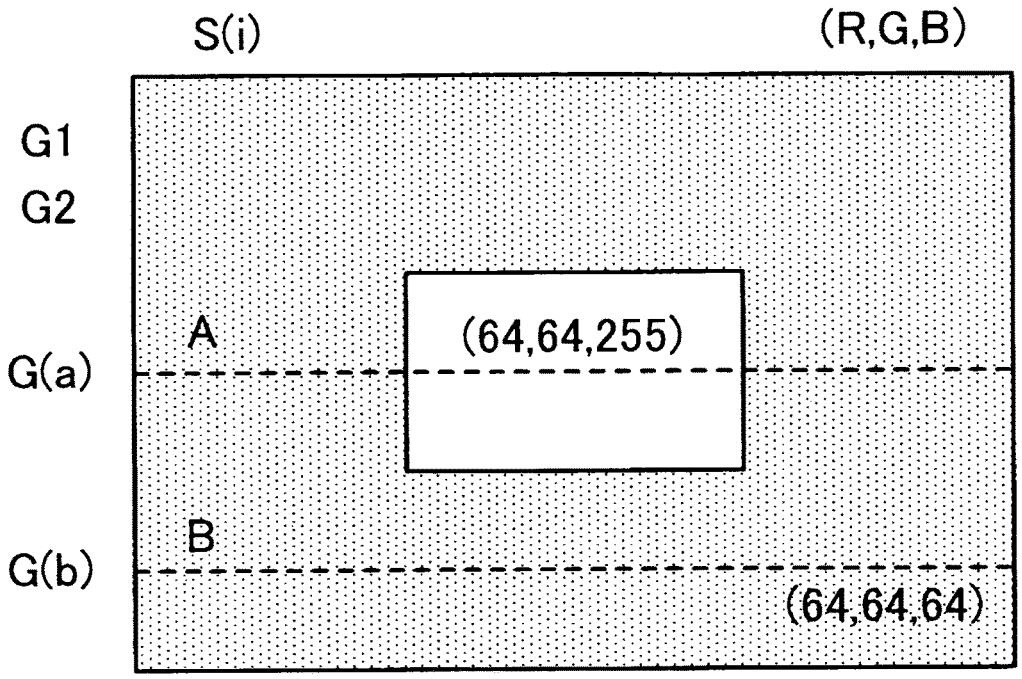
FIG. 4 is an image displayed on the liquid crystal panel according to the first embodiment of the present invention.
Figure 5A:
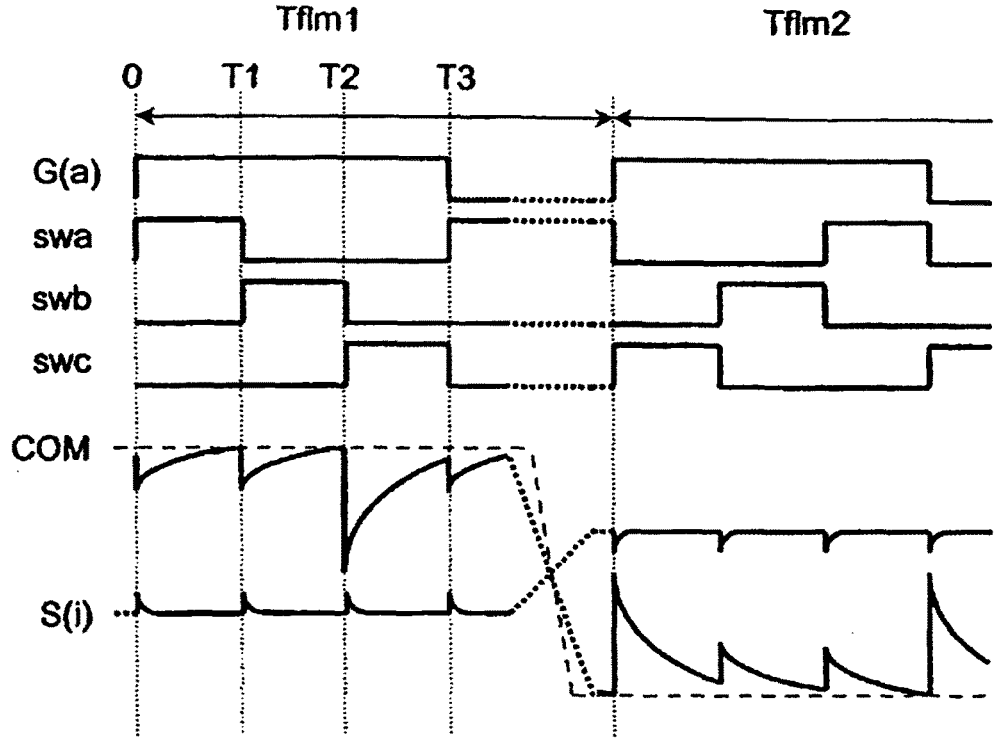
FIGS. 5A and 5B are schematic diagrams illustrating the writing in of a display signal into a pixel electrode according to the first embodiment of the present invention.
Figure 5B:
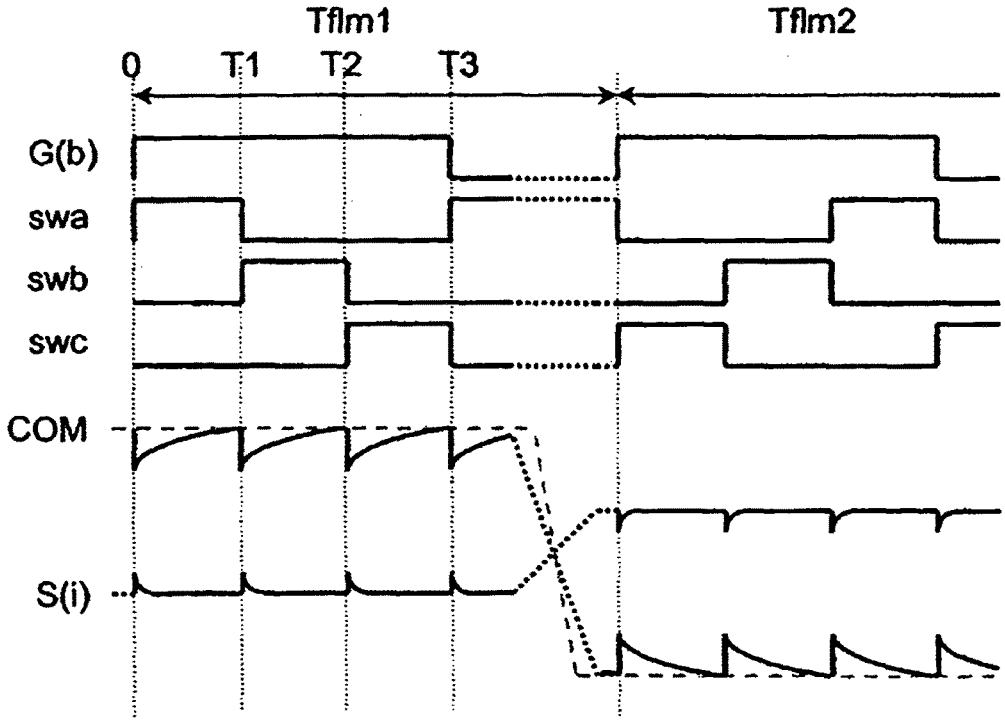
Figure 6:
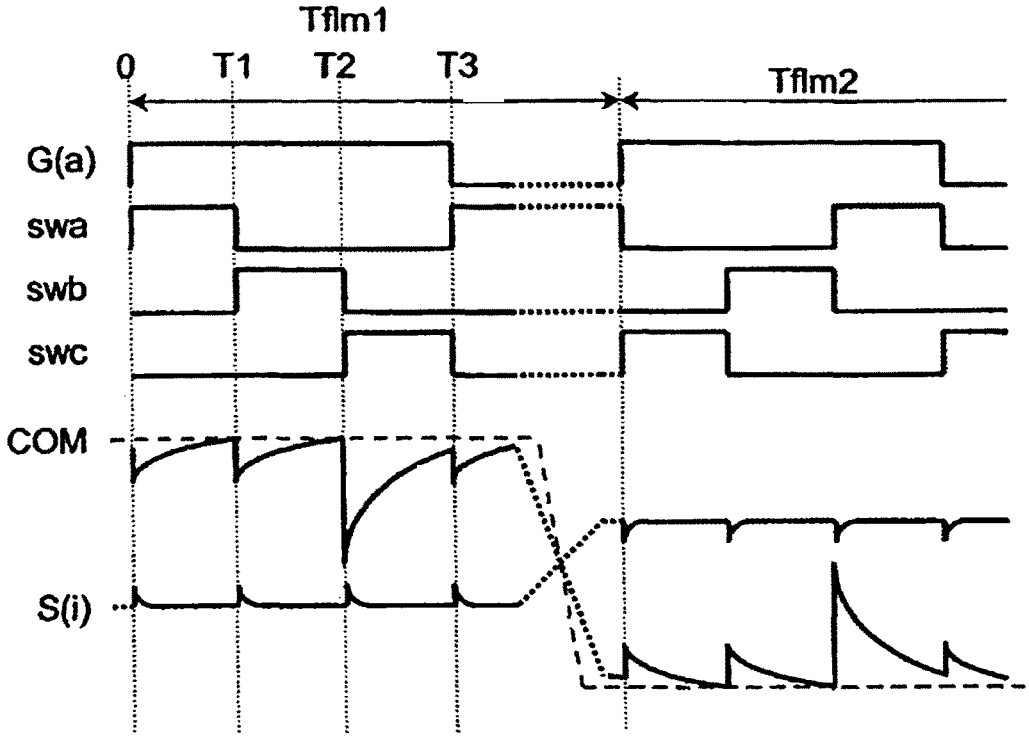
FIG. 6 is a schematic diagram illustrating the writing in of a display signal into a pixel electrode according to a conventional RGB time division drive system.

Here, the fluctuation in the potential in each pixel is focused on, and the effects of preventing the image quality from deteriorating (lateral smearing) due to inconsistency in the display brightness according to the first embodiment of the present invention are described in reference to FIGS. 4, 5 and 6.

FIG. 4 shows a pattern displayed on a liquid crystal panel. A background region with gradation (R, G, B)=(64, 64, 64) and a box region with gradation (R, G, B)=(64, 64, 255) are displayed. Here, the points A and B within the liquid crystal panel in FIG. 4 indicate RGB sub-pixels at respective intersections between the gate lines G(a) and G(b) and the display signal line S(i). Along the gate line G(a), display signals for the background region with gradation (64, 64, 64) and for the box region with gradation (64, 64, 255) are written in on the pixel electrode side via drain lines, while along the gate line G(b), only pixel signals for the background region with gradation (64, 64, 64) are written in on the pixel electrode side via drain lines. Meanwhile, the common potential for the counter electrodes for all of the pixels is supplied from a common power supply, and thus becomes the same potential. Here, the amount of fluctuation in the potential of the drain lines is different, and therefore, the amount of fluctuation in the common potential is different for write-in operation in each gate line, due to the effects of capacitor coupling. Therefore, the ratio of convergence of the common potential to a desired potential becomes different, and the display brightness can be expected to be different between the point A and the point B for displaying the same gradation. The details are described below in reference to FIGS. 5 and 6.

FIG. 5A shows the potential waveform on the pixel electrode side of the drain lines through the point A in FIG. 4, and FIG. 5B that through point B. In addition, FIG. 6 is a diagram showing the fluctuation in the potential of each pixel through point A in accordance with a conventional system. A display signal corresponding to R data is held in R pixels at time T1, a display signal corresponding to G data is held in G pixels at time T2, and finally, a display signal corresponding to B data is held in B pixels at time T3. The gate scanning voltage becomes of a non-selection level after the above described operation, and a display signal corresponding to the display data is written in and held by all of the pixels along the selected gate line. As a result of the above described holding operation, the source signal generating circuit 101 according to the first embodiment of the present invention outputs a display signal corresponding to R data (display signal corresponding to drain line and pixel electrodes which become of holding state at time T1) at least until time T1 or after, and then outputs a display signal corresponding to G data (display signal corresponding to drain line and pixel electrodes which become of holding state at time T2) at least until time T2 or after, and subsequently outputs a display signal corresponding to B data (display signal corresponding to drain line and pixel electrodes which become of holding state at time T3) at least until time T3 or after.

Here, write-in is carried out in the data order of RGB during the Tflm1 period in FIG. 5. In this case, the period for the writing in of G data is switched to the period for the writing in of B data at time T2. Therefore, at time T2, the potential of the drain lines through the portion for displaying a box changes from that of the display signal for G data with 64 grades to that of the display signal for B data with 255 grades. As a result, there is capacitor coupling, due to the fluctuation in the potential of the drain lines on the pixel electrode side at time T2 during the Tflm1 period, and the common potential on the counter electrode side fluctuates greatly to the lower side. In this case, the common potential cannot be expected to converge at the time when the gate selection is turned OFF. Furthermore, the common potential converges to a desired potential after the gate selection is turned OFF. Meanwhile, the liquid crystal capacitor on the pixel electrode side is in a floating state, because the time division switch is in an OFF state. This is a state where the difference in potential in the liquid crystal capacitor is held. That is to say, the potential of the liquid crystal capacitor becomes of a low state for all of the pixels in one horizontal line including the selected point A. Therefore, the display brightness becomes low at the point A on a normally black liquid crystal panel after the completion of the Tflm1 period, and the display brightness becomes high on a normally white liquid crystal panel. Next, write-in is carried out in the data order of BGR during the Tflm2 period. In this case, the fluctuation in the common potential at time 0 when the writing in of B data starts is great, while the fluctuation in the common potential during the period for the writing in of RG data (second selection period and third selection period) is small, and thus, it is possible for the common potential to converge at the time when the gate is turned OFF. That is to say, it is possible to hold the potential of the liquid crystal capacitor at a desired potential for all of the pixels along one horizontal line including the point A. Therefore, at the point A after the completion of the Tflm2 period, a desired display brightness can be gained both in a normally black liquid crystal panel and a normally white liquid crystal panel. Meanwhile, only a display signal for a background region with gradation (64, 64, 64) is written in the horizontal direction through the point B. In this case, the fluctuation in the drain line is small, and the fluctuation in the common potential is small. As a result, it becomes possible to hold the potential of the liquid crystal capacitor at a desired potential for all of the pixels along one horizontal line including the point B.

As described above, the brightness along one horizontal line including the point A along which there is a box is low relative to the desired display brightness in the case of a normally black display, while it is high in the case of a normally white display, so that there is a difference in brightness between the point A and the point B, but one of the two frames has a desired display brightness, and therefore, reduction in the display brightness can be prevented, as compared to the conventional system described below in reference to FIG. 6. Here, the display brightness is integrated in the direction of time to the visual sense of humans, and therefore, the display brightness during Tflm1 and Tflm2 averages out, and thus, theoretically the difference in the display brightness is perceived to be approximately half.

Meanwhile, in the case of the conventional system shown in FIG. 6, write-in is always carried out in the data order of RGB both during the vertical period of Tflm1 and the vertical period of Tflm2 in RGB time division drive. Therefore, at time T2, the period for the writing in of G data is always switched to the period for the writing in of B data. Accordingly, the potential of the liquid crystal capacitor becomes small in comparison with the desired potential for all of the pixels along one horizontal line including the point A, for the same reasons as in FIG. 5, and therefore, the display brightness becomes low on a normally black liquid crystal panel, and the display brightness becomes high on a normally white liquid crystal panel, in comparison to the drive system according to the first embodiment of the present invention shown in FIG. 5. Meanwhile, the potential of the liquid crystal capacitor for all of the pixels along one horizontal line including the point B becomes a desired potential, for the same reasons as in FIG. 5. As a result, the display brightness is not the same between the point A and the point B, that is to say, between one horizontal line along which there is a box and one horizontal line along which there is no box, and in the case of a normally black display, the background portion becomes dark along a horizontal line along which there is a box including the point A in comparison with the background portion with a horizontal line along which there is no box including the point B. Conversely, in the case of a normally white display, the background portion becomes brighter.

The effects of the first embodiment of the present invention in the case where operation for the writing in of a display signal is carried out as shown in FIG. 2 are described in reference to the above FIGS. 4, 5 and 6. In the case of FIG. 2, the potential of the liquid crystal capacitor is different between the positive and negative polarities for all of the pixels, and therefore, the state is such that a direct current voltage (DC voltage) is applied to the liquid crystal capacitor. When this state where a DC voltage is applied is left, the DC voltage remains within the liquid crystal capacitor in such a state that the potential of the pixels is set to 0 V, and thus afterimage, burning and leakage of brightness occur. In order to prevent such deterioration of image quality, the order of RGB time division drive is inverted between the positive and negative polarity with a period of several frame (several tens of ms) to several thousands of frame (several min) units. That is to say, the direction in which a DC voltage is applied is inverted, so that the data order is BGR for the positive polarity, and the data order is RGB for the negative polarity. It is possible to prevent deterioration of image quality due to the DC voltage by incorporating the above described functions. In addition, it is desirable for the setting where the data order is switched between the positive polarity and the negative polarity to be the register setting.

In addition, the above described method for avoiding the DC voltage is possible also in the case where operation for the writing in of a display signal is carried out as shown in FIG. 3. In this case, the order in which data is written in is the data order RGB during the time Tflm1 for the writing in of a negative display signal and during the time Tflm2 for the writing in of a positive display signal. That is to say, it becomes possible to cancel the DC voltage generated in the order in which RGB data is written in during two frames. In addition, it is possible to gain the same effects as in the first embodiment of the present invention in the case of operation for the writing in of a display signal in FIG. 3.

As described above, in the first embodiment of the present invention, each horizontal period is divided into three periods: a first selection period (time 0 to time T1), a second selection period (time T1 to time T2) and a third selection period (time T2 to time T3), for time division drive, where the period is switched between two frames: a first frame, where the order according to which data is written in through time division is the order of RGB data, and a second frame, where the order is the order of BGR data, or the period is switched between four frames for drive: a first frame and a second frame, where the order in which time division data is written in to a frame where a continuous write-in operation for the positive polarity is carried out, and to a frame where a write-in operation for the negative polarity is carried out, is the order of RGB data, and a subsequent third frame and a fourth frame, where the order in which time division data is written in to a frame where a continuous write-in operation for the positive polarity is carried out, and to a frame where a write-in operation for the negative polarity is carried out is the order of BGR data. In this case, it becomes possible in the display pattern shown in FIG. 4 to evenly distribute the timing with which B data is written in to increase the common potential in a portion where the amount of fluctuation in the common potential is great (point A) between the first selection period and the third selection period. The common potential should converge by the time when the gate is turned OFF, by the time when the third selection period is completed (T3), and therefore, in the case where the time when the B data is written in is in the first selection period, the common potential can converge, so that the difference in the display brightness between the point A and the point B is smaller, and thus, it becomes possible to reduce lateral smearing.

Figure 7:
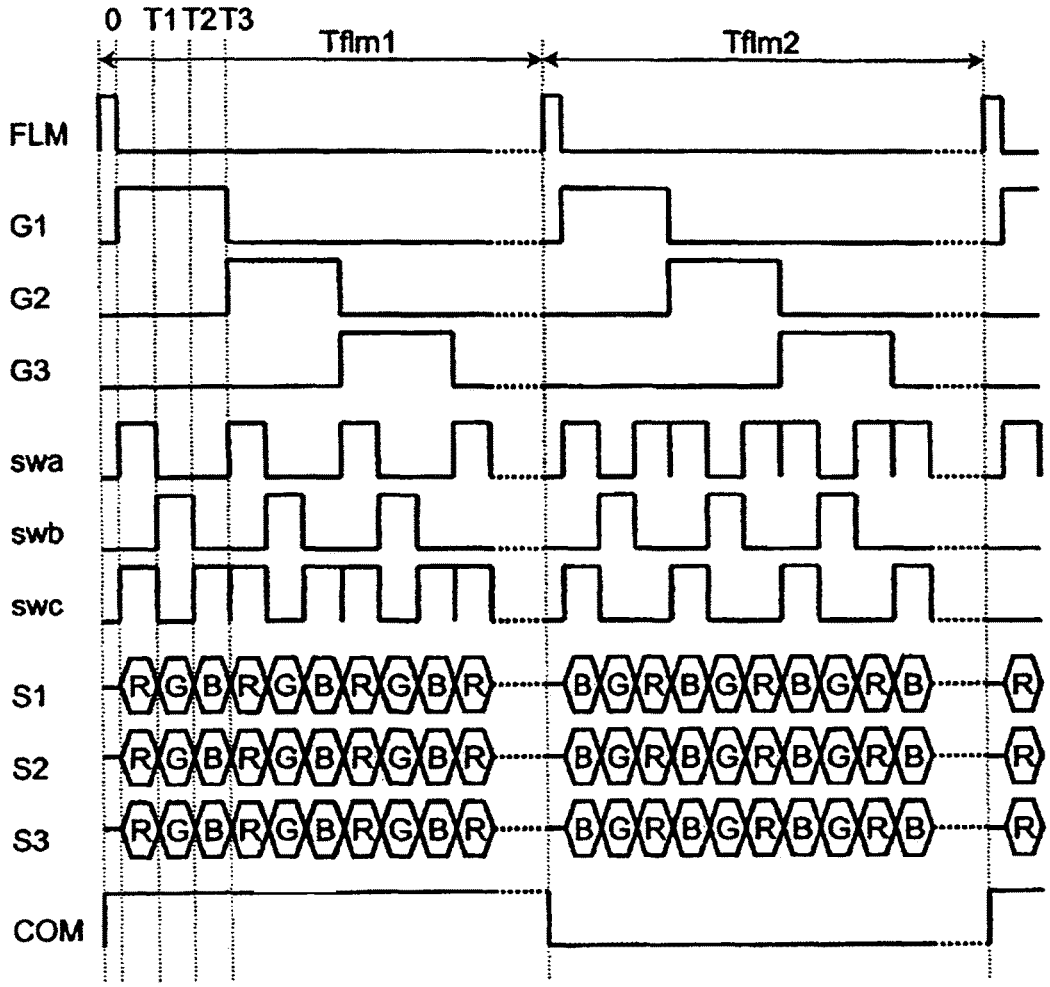
FIG. 7 is a chart showing voltage waveforms and timing according to the first embodiment of the present invention.

In addition, as shown in FIG. 7, each horizontal period in the Tflm1 period is time divided into three periods: a first selection period (time 0 to time T1), a second selection period (time T1 to time T2) and a third selection period (time T2 to time T3) for drive. Here, in the case where the period is switched between two frames: a first frame, where the order in which data is written in through time division is the RGB data, and a second frame, where the order is the BGR data, the time division switches for R and B are turned ON during the first selection period, the time division switch for G is turned ON during the second selection period, and the time division switches for R and B are turned ON during the third selection period for driving the first frame, while the time division switches for R and B are turned ON during the first selection period, the time division switch for G is turned ON during the second selection period, and the time division switch for R is turned ON during the third selection period for driving the second frame. In this case, in the first frame, the R data is written into pixels for B during the first selection period, and desired B data is written into pixels for B during the third selection period, while in the second frame, the B data is written in for pixels for R during the first selection period, and desired R data is written into pixels for R during the third selection period. In the display pattern shown in FIG. 4, the R data with 64 grades is once written into pixels for B during the first selection period, and desired B data (with 255 grades) is written into pixels for B during the third selection period. Focusing on the liquid crystal capacitor for the pixels for B, in the case of FIGS. 2 and 3, the voltage applied to pixels changes from 255 grades with negative polarity, that is to say, a state where the maximum potential is written in, to 255 grades with positive polarity (maximum potential) in the previous frame, while in the case of FIG. 7, the voltage applied to pixels once changes from 255 grades with a negative polarity during the first period, that is to say, a state where the maximum potential is written in, to 64 grades with a positive polarity, and then the voltage applied to pixels changes to 255 grades (maximum potential) with a positive polarity during the third period. Therefore, it is possible to reduce fluctuation in the common potential for the pixels for B during the third selection period.

In addition, in the case where the period is switched between four frames: a first frame and a second frame, where the order in which time division data is written in a frame for carrying out a continuous operation for the writing in of the positive polarity, and a frame for carrying out an operation for the writing in of the negative polarity, is the order of RGB data, and a subsequent third frame and a fourth frame, where the order in which time division data is written in a frame for carrying out a continuous operation for the writing in of the positive polarity, and a frame for carrying out an operation for the writing in of the negative polarity, is the order of RGB data, is the order of the BGR data, it is possible to combine the operation for turning on the time division switches for R and B simultaneously during the above described first selection period, so that the common fluctuation can be reduced in the same manner, and thus, it is possible to reduce lateral smearing.

Figure 8:
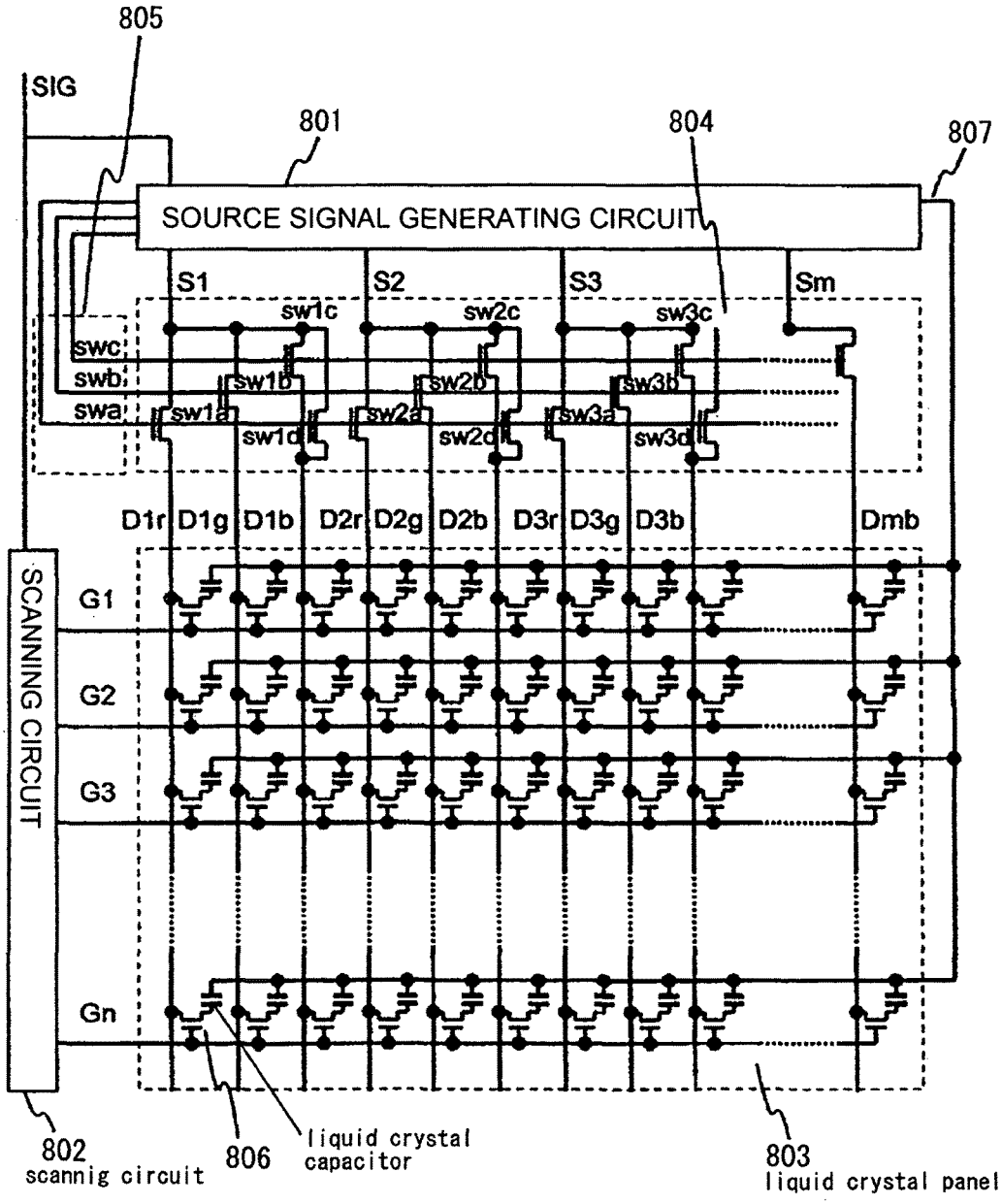
FIG. 8 is a diagram showing the configuration of the liquid crystal display device according to the first embodiment of the present invention.

In addition, the liquid crystal display device shown in FIG. 8 has approximately the same configuration as the liquid crystal display device shown in FIG. 1, but is different in that one display signal line S is connected to four time division switches sw, and the drain lines connected to the pixels 4B are connected to two time division switches. A group of display signal lines (S1, S2, S3 . . . ) are connected to a group of drain lines (Dr1, Dg1, Db1, Dr2, Dg2, Db2, Dr3, Dg3, Db3 . . . ) via a group of time division switches 804 (sw1*a*, sw1*b*, sw1*c*, sw1*d*, sw2*a*, sw2*b*, sw2*c*, sw2*d*, sw3*a*, sw3*b*, sw3*c*, sw3*d* . . . ), and swa controls sw1*a*, sw1d, sw2*a*, sw2*d*, sw3*a*, sw3*b* . . . , swb controls sw1*b*, sw2*b*, sw3*b* . . . , and swc controls sw1*c*, sw2*c*, sw3*c* . . . , from among the time division switch control signal 508 for controlling a group of time division switches 804.

In this case, it becomes possible to carry out the operation for the writing in RGB data during the Tflm1 period shown in FIG. 7 when the output timing in the source signal generating circuit 801 follows the order of the RGB data, as in the prior art. Here, in the case of the liquid crystal display device in FIG. 8, the order of the time division output cannot be changed for each frame as shown in FIG. 7, and therefore, the data order should not be switched for each frame. In addition, though the order for outputting data is the order of the RGB data in the present FIG. 8, the order may also be GBR or BGR.

Figure 9:
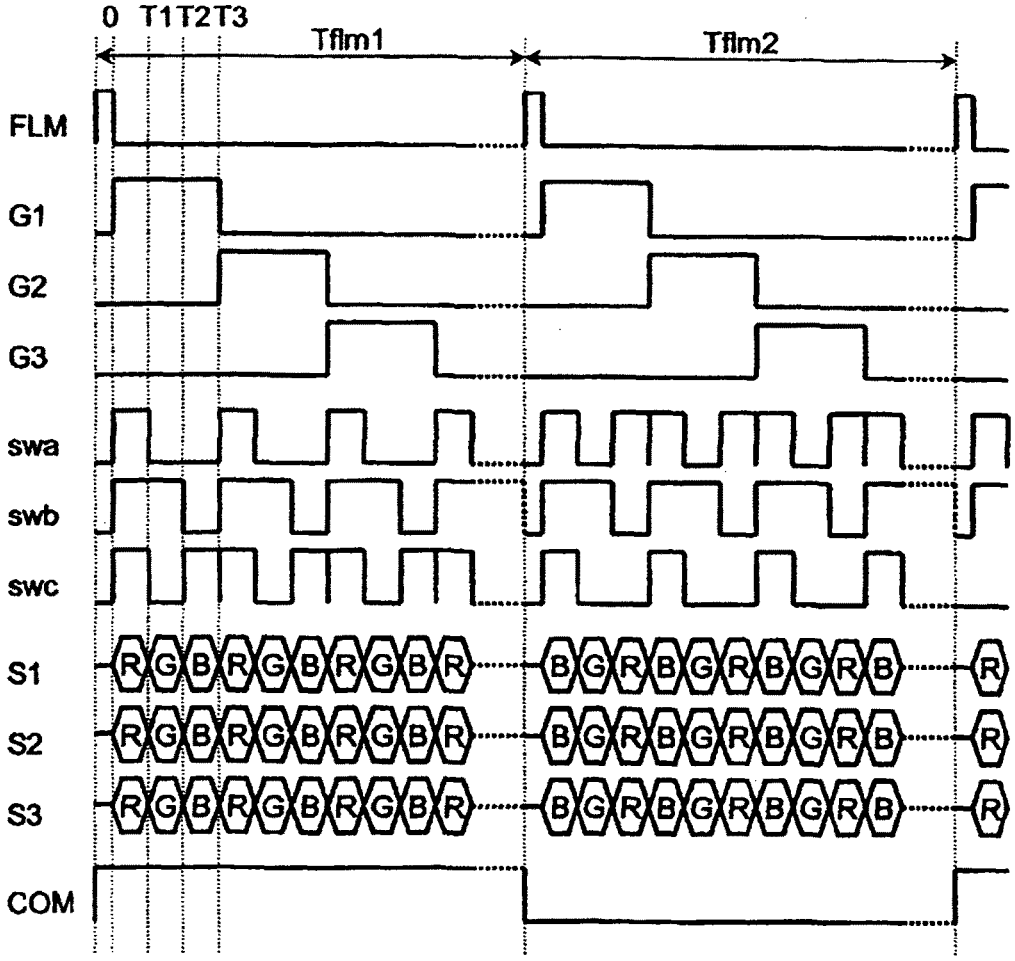
FIG. 9 is a chart showing voltage waveforms and timing according to the first embodiment of the present invention.

In addition, the driving method shown in FIG. 9 is different from the driving method shown in FIG. 7 in that the time division switches for R and B are turned ON simultaneously during the first selection period, and in accordance with the driving method shown in FIG. 8, the time division switches for R, G and B are simultaneously turned ON during the first selection period. The rest is the same as in the driving method shown in FIG. 7. In this case, it is possible to write in the G data in advance during the first selection period. Therefore, in the case where the gradation in the box portion is (64, 255, 64) in the display image shown in FIG. 4, the G and B data are written in during the first selection period, and therefore, there is little fluctuation in the common potential at time T2, when the B data is written in. Accordingly, the writ-in of the G data at time T1, when the second selection period starts, mostly relates to the conversion of the common potential at time T3, when the gate is turned OFF, in this case. Thus, in the present system, the R data is written into the G data during the first selection period, and therefore, it is possible to reduce fluctuation in the common potential when the writing in of G data starts, the drain lines change from 64 grades of the positive polarity to 255 grades of the positive polarity (maximum potential), as compared to the case of FIG. 7, where the drain lines change from 255 grades (maximum potential) of the positive polarity to 255 grades (minimum potential) of the negative polarity. Here, in the case where the color of the above described box is (0, 255, 0) instead of (64, 255, 64), the same effects cannot be gained.

Figure 10:
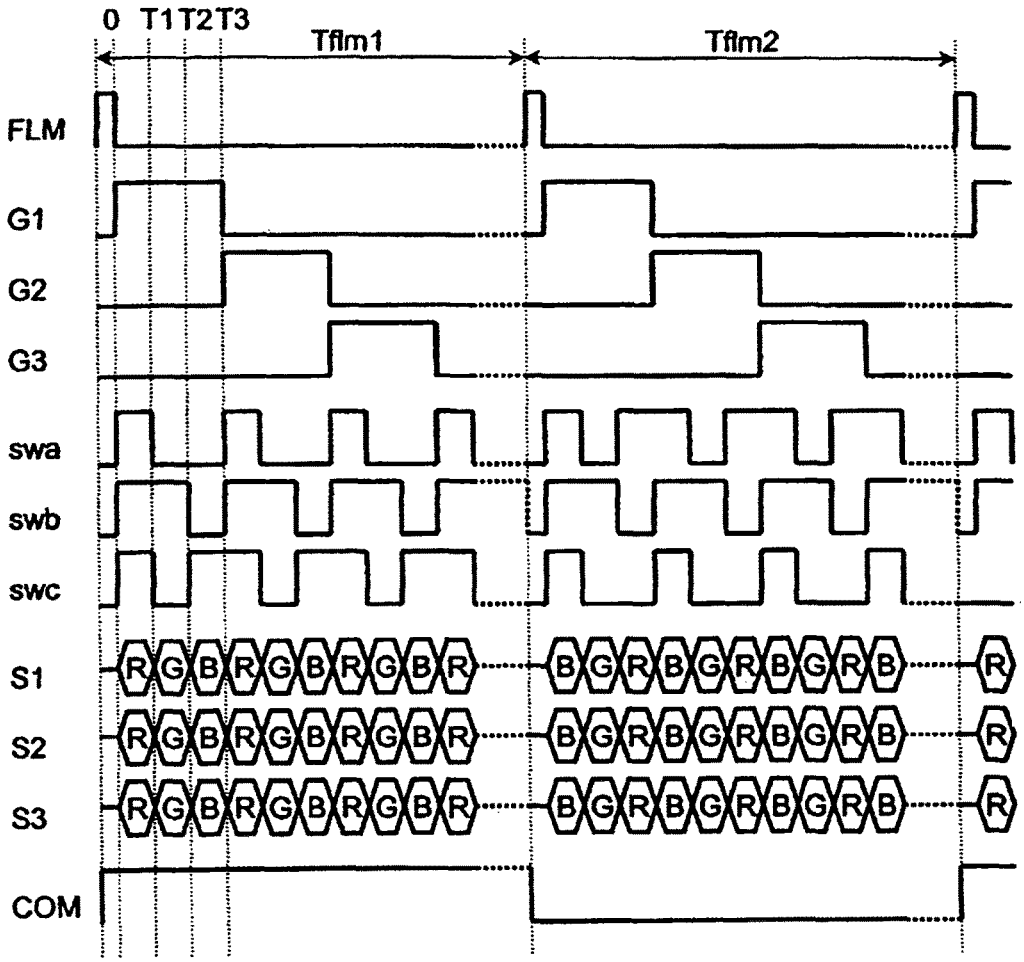
FIG. 10 is a chart showing voltage waveforms and timing according to the first embodiment of the present invention.

In addition, the driving method shown in FIG. 10 is different from the driving method shown in FIG. 9 in that the time division switch 4B is turned OFF after the gate line is turned OFF without turning OFF the time division switch 4B when the third selection period is completed. The rest is the same as in the driving method shown in FIG. 8. In the case of the RGB time division drive, where RGB pixels are written into the time division in this order, for example, the time division switch for the G data is turned ON when the time division switch for the R data is turned OFF, and the time division switch for the B data is turned ON when the time division switch for the G data is turned OFF, but other time division switches are not operated when the time division switch for the B data is turned OFF. Therefore, only the conditions when the writing in of B data is completed are different from other conditions, and therefore, the picture quality deteriorates, so that the y properties of the B data change. As shown in FIG. 10, it is possible to avoid the effects of the potential fluctuating when the time division switch is turned OFF in order to turn OFF the gate line before the time division switch for the B data is turned OFF in order to negate the effects of the time division switch when the writing in of the B data is completed.

In addition, though in the first embodiment of the present invention, it is possible to set an arbitrary selection period for the respective RGB time division drive, shortage of the writing in can be expected in the case where the operation for the writing in shown in FIGS. 7, 9 and 10 is carried out, because the number of pixels in which the display signal is written in during the first selection period doubles or triples. This can be avoided by making the first selection period longer than the other selection periods.

In addition, though a common potential is used for all of the pixels in the first embodiment of the present invention, it is possible to apply the present invention to a configuration where one potential is shared by all of the lines or a configuration where the potential is shared by odd lines and another potential is shared by even lines.

In addition, though the frame is inverted in the first embodiment of the present invention, the invention can be implemented for the drive for inverting lines.

Figure 11:
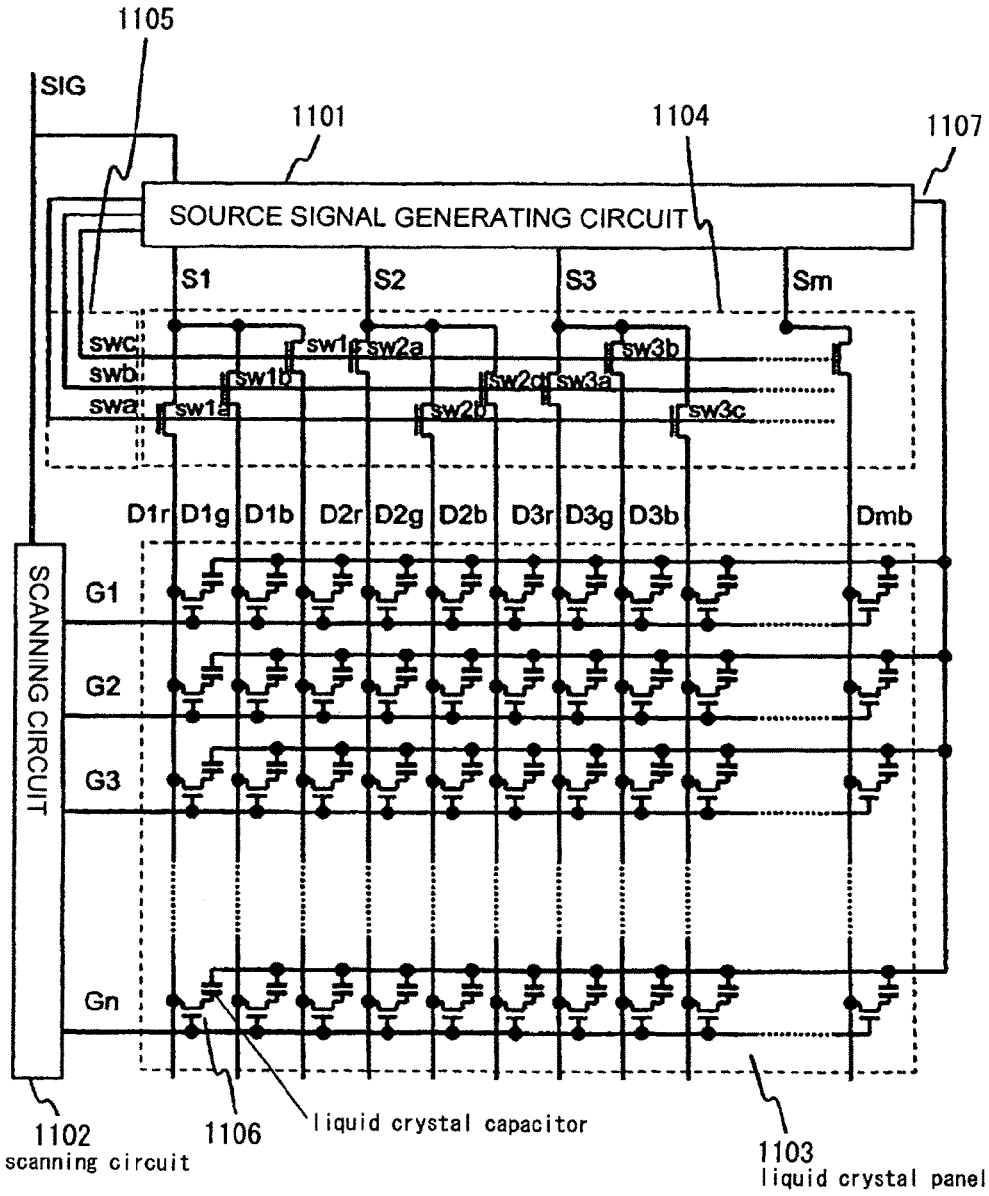
FIG. 11 is a diagram showing the configuration of the liquid crystal display device according to the second embodiment of the present invention.
Figure 12:
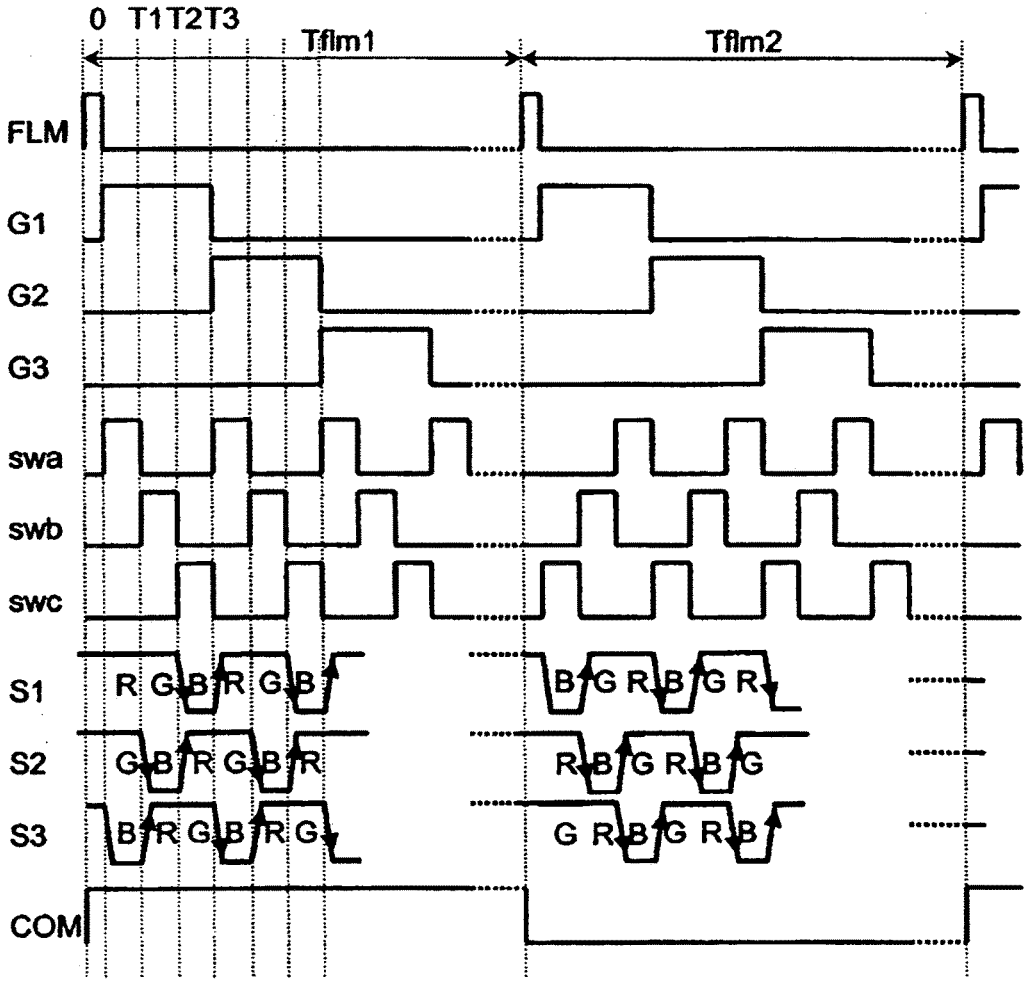
FIG. 12 is a chart showing voltage waveforms and timing according to the second embodiment of the present invention.

Next, the second embodiment of the present invention is described in reference to FIGS. 11 and 12. FIG. 11 is a diagram showing the configuration of the liquid crystal display device according to the second embodiment of the present invention. The configuration shown in FIG. 11 is different from that in FIG. 1 in the group of time division switches 1104, and the rest is the same as in FIG. 1.

The group of display controlling signals inputted into the group of time division switches 1104, the time division switches and the time division switch controlling signals are formed as follows. First, concerning the group of display signal lines S1, S4, S7 . . . within the group of display signal lines (S1, S2, S3 . . . ), the time division switches sw1*a*, sw4*a*, sw7*a* . . . for turning ON/OFF the connection of the drain lines Dr1, Dr4, Dr7 . . . for the writing in of the pixels for R have a configuration controlled by the time division switch controlling signal swa, the time division switches sw2*a*, sw5*a*, sw7*a* . . . for turning ON/OFF the connections of the drain lines Dr2, Dr5, Dr8 . . . for the writing in of the pixels for G have a configuration controlled by the time division switch controlling signal swb, and the time division switches sw3*a*, sw6*a*, sw9*a* . . . for turning ON/OFF the connection of the drain lines Dr3, Dr6, Dr9 . . . for the writing in of the pixels for B have a configuration controlled by the time division switch controlling signal swc. Next, concerning the group of display signal lines S2, S5, S8 . . . from among the group of display signal lines (S1, S2, S3 . . . ), the time division switches sw1*a*, sw4*a*, sw7*a* . . . for turning ON/OFF the connection of the drain lines Dr1, Dr4, Dr7 . . . for the writing in of the pixels for R have a configuration controlled by the time division switch controlling signal swc, the time division switches sw2*a*, sw5*a*, sw7*a* . . . for turning ON/OFF the connections of the drain lines Dr2, Dr5, Dr8 . . . for the writing in of the pixels for G have a configuration controlled by the time division switch controlling signal sw*a*, and the time division switches sw3*a*, sw6*a*, sw9*a* . . . for turning ON/OFF the connection of the drain lines Dr3, Dr6, Dr9 . . . for the writing in of the pixels for B have a configuration controlled by the time division switch controlling signal swb. Finally, concerning the group of display signal lines S3, S6, S9 . . . from among the group of display signal lines (S1, S2, S3 . . . ), the time division switches sw1*a*, sw4*a*, sw7*a* . . . for turning ON/OFF the connection of the drain lines Dr1, Dr4, Dr7 . . . for the writing in of the pixels for R have a configuration controlled by the time division switch controlling signal swb, the time division switches sw2*a*, sw5*a*, sw7*a* . . . for turning ON/OFF the connections of the drain lines Dr2, Dr5, Dr8 . . . for the writing in of the pixels for G have a configuration controlled by the time division switch controlling signal swc, and the time division switches sw3*a*, sw6*a*, sw9*a* . . . for turning ON/OFF the connection of the drain lines Dr3, Dr6, Dr9 . . . for the writing in of the pixels for B have a configuration controlled by the time division switch controlling signal swa.

Next, the operation of the writing in of a display signal during a horizontal period according to the second embodiment of the present invention is described in reference to FIG. 12. FIG. 12 shows a voltage waveform and a timing chart according to the second embodiment of the present invention, and a case where a display signal is written in focusing on a certain horizontal period in a state of gate selection during either the vertical period for carrying out an operation for the writing in of a display signal with negative polarity (Tflm1) or the vertical period for carrying out an operation for the writing in of a display signal with negative polarity (Tflm2) is cited as an example. The gate operation voltage G in FIG. 12 indicates the gate voltage waveform of the horizontal line in a state of writing in, and the gate selection period is within one horizontal period. According to the second embodiment of the present invention, in the case of RGB time division drive, where the rise of the gate scanning voltage is at time 0, one horizontal period is time divided into three periods: a first selection period from time 0 to time T1, a second selection period from time T1 to time T2, and a third selection period from time T2 to time T3. Here, time T1, T2 and T3 can be set arbitrarily. Here, the time satisfies the relationship $0<T1<T2<T3$.

In the second embodiment of the present invention, as shown in the control signal waveform in FIG. 12, during the vertical period for carrying out an operation for the writing in of a display signal with the negative polarity (Tflm1), swa within the time division switch controlling signal is at a HIGH potential and swb and swc are at a LOW potential during the first selection period, that is to say, from time 0 to time T1, swb within the time division switch controlling signal is at a HIGH potential and swa and swc are at a LOW potential during the second selection period, that is to say, from time T to time T2, and swc within the time division switch controlling signal is at a HIGH potential and swa and swb are at a LOW potential during the third selection period, that is to say, from time T2 to time T3. Here, during the first selection period, as described in reference to FIG. 11, the group of display signal lines S1, S4, S7 . . . for connecting the time division switch control signal swa to the drain lines Dr1, Dr4, Dr7 . . . for the writing in of the pixels for R outputs R data, the group of display signal lines S2, S5, S8 . . . for connecting the time division switch control signal swa to the drain lines Dg2, Dg5, Dg8 . . . for the writing in of the pixels for G outputs G data, and the group of display signal lines S3, S6, S9 . . . for connecting the time division switch control signal swa to the drain lines Db3, Db6, Db9 . . . for the writing in of the pixels for B outputs B data. In addition, during the second selection period, the group of display signal lines S1, S4, S7 . . . for connecting the time division switch control signal swb to the drain lines Dg1, Dg4, Dg7 . . . for the writing in of the pixels for G outputs G data, the group of display signal lines S2, S5, S8 . . . for connecting the time division switch control signal swb to the drain lines Db2, Db5, Db8 . . . for the writing in of the pixels for B outputs B data, and the group of display signal lines S3, S6, S9 . . . for connecting the time division switch control signal swa to the drain lines Dr3, Dr6, Dr9 . . . for the writing in of the pixels for R outputs R data. In addition, during the third selection period, the group of display signal lines S1, S4, S7 . . . for connecting the time division switch control signal swc to the drain lines Db1. Db4, Db7 . . . for the writing in of the pixels for B outputs B data, the group of display signal lines S2, S5, S8 . . . for connecting the time division switch control signal swc to the drain lines Dr2, Dr5, Dr8 . . . for the writing in of the pixels for R outputs R data, and the group of display signal lines S3, S6, S9 . . . for connecting the time division switch control signal swc to the drain lines Dg3, Dg6, Dg9 . . . for the writing in of the pixels for G outputs G data.

The effects of the second embodiment of the present invention in the case where the image in FIG. 4 is displayed are described in the following. In the gate line G(a), which includes the pixel at point A in FIG. 4, there is a blue box (64, 64, 255) against a gray background with 64 grades. In this case, during the Tflm1 period, the group of display signal lines S1, S4, S7 . . . is affected, so that the common potential lowers during the third selection period, the group of display signal lines S2, S5, S8 . . . is affected, so that the common potential lowers during the second selection period, and the group of display signal lines S3, S6, S9 . . . is affected, so that the common potential lowers during the first selection period. As described above, in terms of the timing according to which the common potential fluctuates, ⅓ of the display signal lines is during the first selection period, ⅓ of the display signal lines is during the second selection period, and ⅓ of the display signal lines is during the third selection period, and therefore, it becomes possible for the fluctuation in the common potential to be distributed between the respective selection periods. In addition, during the Tflm2 period also, ⅓ of the display signal lines is during the first selection period, ⅓ of the display signal lines is during the second selection period, and ⅓ of the display signal lines is during the third selection period, and therefore, it becomes possible for the fluctuation in the common potential to be distributed between the respective selection periods.

As shown in the first embodiment of the present invention, the frame for drive is switched between the first frame, where the order of the writing in of data through time division is the order of the RGB data, and the second frame, where the order is BGR data, in the RGB time division drive of the liquid crystal panel having time division switches.

In addition, as shown in the second embodiment of the present invention, the control signal lines for the time division switches and the time division switches for the RGB data are connected in the configuration, so that ⅓ of the display signal lines writes in the R data (or G or B data) during the first selection period, ⅓ of the display signal lines writes in the R data (or G or B data) during the second selection period, and ⅓ of the display signal lines writes in the R data (or G or B data) during the third selection period.

The above described configuration can be implemented and the driving operation and timing operation carried out so that the common potential can be prevented from fluctuating or the fluctuation can be distributed, and thus, deterioration in the image quality due to inconsistency in the display brightness, that is to say, lateral smearing, can be prevented.

In addition, it becomes possible to reduce the number of connection terminals between the liquid crystal panel (time division switches) and the source signal generating circuit by using RGB time division drive. As a result, the precision and resolution of the liquid crystal panel can be improved. Furthermore, it becomes possible to increase the yield in manufacture when the number of connection terminals is reduced. At the same time, reduction in the cost of the liquid crystal display device as a whole can be achieved when the number of terminals for the source signal generating circuit is reduced.

While we have shown and described several embodiments in accordance with our invention, it should be understood that disclosed embodiments are susceptible to change and modifications without departing from the scope of the invention. Therefore, we do not intend to be bound by the details shown and described herein, but intend to cover all such changes and modifications within the ambit of the appended claims.

What is claimed is:

1. A display device, comprising:

a display panel wherein each of a plurality of pixels includes a sub-pixel for red, a sub-pixel for green and a sub-pixel for blue; and a drive circuit for supplying a display signal for red, a display signal for green and a display signal for blue to said sub-pixel for red, said sub-pixel for green and said sub-pixel for blue, respectively, within one horizontal period through time division, wherein said one horizontal period is divided into a number of selection periods, said drive circuit switches the type of display signal to each of the plurality of pixels at each selection period of the one horizontal period, the types of display signals being red, green and blue, during first and second adjacent frame periods, said drive circuit fixes a first order of the display signals during the first frame period to the sub-pixel for red at a first selection period, the sub-pixel for green at a second selection period different from the first selection period and the sub-pixel for blue at a third selection period different from the first and second selection periods, said drive circuit fixes a second order of the display signals during the second frame period different from the first order to the sub-pixel for blue at a first selection period, the sub-pixel for green at a second selection period and the sub-pixel for red at a third selection period, said drive circuits repeats the first and second frame periods with the corresponding orders of the display signals fixed therein, said drive circuit further includes a plurality of time division switches, each time division switch corresponding to each of said sub-pixel for red, said sub-pixel for green and said sub-pixel for blue, respectively, the time division switches corresponding to the sub-pixel for red and the sub-pixel for blue being turned on simultaneously during the first selection period, a polarity of the display signals of all sub-pixels is inverted between a positive and a negative polarity with the first frame period and the second frame period, and a direction of the first order is inverted relative to a direction of the second order.

* * * * *